US008142088B2

(12) United States Patent
Nishitani

(10) Patent No.: US 8,142,088 B2
(45) Date of Patent: Mar. 27, 2012

(54) PRINT MEDIUM CARTRIDGE WHICH HAS AN ELASTIC PARTITION MEMBER WHICH INCREASES THE CAPACITY OF A CUT PIECE COLLECTION PORTION

(75) Inventor: Hitoshi Nishitani, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 454 days.

(21) Appl. No.: 12/338,217

(22) Filed: Dec. 18, 2008

(65) Prior Publication Data

US 2009/0180823 A1 Jul. 16, 2009

(30) Foreign Application Priority Data

Jan. 10, 2008 (JP) ..... 2008-003639

(51) Int. Cl.
*B41J 11/00* (2006.01)
*B41J 15/00* (2006.01)

(52) U.S. Cl. ..... 400/621; 400/613

(58) Field of Classification Search ..... 400/621, 400/613, 615, 615.1
See application file for complete search history.

(56) References Cited

U.S. PATENT DOCUMENTS 6,904,249 B2 * 6/2005 Kato et al. ..... 399/120
6,916,132 B2 * 7/2005 Otsuka et al. ..... 400/621

FOREIGN PATENT DOCUMENTS

| | | |
|---|---|---|
| JP | 10-202972 | 8/1998 |
| JP | 2001-139212 | 5/2001 |
| JP | 2001-163459 | 6/2001 |
| JP | 2002-103286 | 4/2002 |
| JP | 2002-226096 | 8/2002 |
| JP | 2002-301876 | 10/2002 |
| WO | WO 2007/119387 | * 10/2007 |

* cited by examiner

*Primary Examiner* — Judy Nguyen
*Assistant Examiner* — Blake A Tankersley
(74) *Attorney, Agent, or Firm* — Cowan, Liebowitz & Latman, P.C.

(57) ABSTRACT

A cartridge that is detachable from a printing apparatus that includes a printing unit that prints onto a print medium and a cutter member that cuts the print medium, the cartridge comprises a print medium containment portion that contains print medium that are consumed along with printing operations performed by the printing unit, a cut piece collection portion that collects cut pieces of the print medium resulting from cutting operations performed by the cutter member are formed integrally in the cartridge and a partition member that separates the print medium containment portion from the cut piece collection portion, wherein the partition member is movable.

8 Claims, 19 Drawing Sheets

PRINT MEDIUM CARTRIDGE WHICH HAS AN ELASTIC PARTITION MEMBER WHICH INCREASES THE CAPACITY OF A CUT PIECE COLLECTION PORTION

BACKGROUND OF THE INVENTION

1. Field of the Invention

The present invention relates to a cartridge that contains print medium or ink sheets, and to a printing apparatus whose cartridge is detachable and that prints images onto print medium or the like.

2. Description of the Related Art

Conventional printing apparatuses used as output apparatuses for printing images from personal computers (PCs), digital cameras, and the like are classified into thermal printing apparatuses, inkjet printing apparatuses, laser printing apparatuses, dot matrix printing apparatuses, and so on depending on the recording technique. In particular, thermal printers utilize ink sheets and print sheets, selectively energizing multiple heating elements arrayed in the main-scanning direction and conveying the inks sheets and print sheets in the sub-scanning direction, thereby printing onto the print sheets. Due to the recent progress in devices that handle images, such as digital cameras, digital video cameras, scanners, and so on, serving as input apparatuses, thermal printers are garnering more and more attention.

Two types of thermal printers have gone into production. One has a configuration in which print sheets cut out at a set size are laminated (stacked) and are supplied in such a form, and the other has a configuration that supplies a continuous print sheet wound into a roll and cuts the print sheet to an appropriate size after printing.

Although the size is large with the configuration that cuts the roll-type print sheet, a large amount of print sheets can be supplied at once, which provides an advantage in that running costs can be significantly reduced.

A thermal printer uses metallic rollers called capstan rollers (or grip rollers) to convey the paper with high precision, which prevents the colors yellow, magenta, and cyan from becoming misaligned when those colors are overlapped and transferred. However, a paper conveyance mechanism that uses capstan rollers has a disadvantage in that a region that cannot be printed onto is present in a part of the print sheet, resulting in the occurrence of margins. Japanese Patent Laid-Open No. H10-202972 discloses a technique for reducing such margins to the greatest extent possible when using a capstan roller paper conveyance mechanism.

Because the act of printing photographs has recently increased in commercial markets, there is a significant demand for full-surface, borderless printing, with no margins; thermal printers have met this demand using the following two methods. In the first method, the print sheets are perforated in advance, and the user cuts off the end of the printed product, including the margins, along the perforation by hand after printing has finished. In the second method, a cutter provided within the device automatically cuts off the end of the printed product, including the margins. Japanese Patent Laid-Open No. 2002-301876 and Japanese Patent Laid-Open No. 2001-139212 disclose the first method, in which perforations are provided in the print sheets, and the second method, in which a cutter is provided in the printer, respectively.

While the above first method is advantageous in the sense that a cutter need not be provided within the printer and thus the device can be kept small and simple, such a method places a significant burden on the user and thus reduces the usability.

Therefore the configuration that includes a cutter has been more advantageous for the user. In particular, with a printer that employs a print sheet in roll form, a cutter is already provided within the printer for the purpose of cutting the roll-type print sheet after printing, and thus the second method can be implemented without adding more components. Therefore, a printer that employs print sheets in roll form can provide printed products printed across the entire surface of the sheet, with no margins, using the second method.

FIG. 15A is a cross-section illustrating an example of the configuration of a conventional printer provided with a cutter and a print sheet in roll form, conceptually illustrating the printer at an exaggerated scale for the sake of simplicity.

In FIG. 15A, reference numeral 101 denotes a thermal head in which multiple heaters are arrayed linearly. Reference numeral 102 denotes an ink sheet that is coated with an ink layer. Reference numeral 103 denotes a platen roller provided opposite to the thermal head 101. Reference numeral 104 denotes capstan rollers, in which a driving roller and a slave roller are provided as a pair.

Reference numeral 105 denotes a cartridge housing that is detachable from the printer. Reference numeral 106 denotes a continuous print sheet, wound in roll form, that is contained in the cartridge housing 105. Reference numeral 107 denotes conveyance rollers, in which a driving roller and a slave roller are provided as a pair. Reference numeral 108 denotes discharge rollers, in which a driving roller and a slave roller are provided as a pair. Reference numeral 109 denotes a cutter member capable of cutting the print sheet 106 in roll form. Finally, reference numeral 110 denotes a cut piece collection receptacle for collecting the cut pieces cut by the cutter member 109.

As described in the above patent documents, a configuration that uses the capstan rollers 104 performs printing while conveying the print sheet 106 from the thermal head 101 toward the capstan roller 104, and thus printing is performed in the direction indicated by A in FIG. 15A. Printing is realized by pressurizing the ink sheet 102 and the print sheet 106 between the thermal head 101 and the platen roller 103, whereby heat emitted by the thermal head 101 causes the ink on the ink sheet 102 to be sublimed and thus transferred onto the surface of the print sheet 106. At the same time, the print sheet 106 is conveyed by the pair of capstan rollers 104 provided downstream from the printing direction A. In order to print subsequent colors after the first color has been printed, the pressure of the thermal head 101 is released, and the capstan rollers 104 are rotated in the direction opposite to that used during printing, returning the print sheet 106 to the starting position for printing. The second and subsequent colors are then printed using the same operation as that used for the first color.

FIG. 16 is a diagram illustrating operations performed by the conventional printer illustrated in FIG. 15A.

FIG. 16 uses arrows and the numbers (1) through (7) to illustrate the movement of the print sheet 106 throughout the procedure in which the roll-type print sheet 106 is extracted, an image is printed thereupon, and the print sheet 106 is cut and discharged. The dot-dash line P indicates the position where printing is performed; the dot-dash line C indicates the position where the cutter member 109 cuts the print sheet 106; and the dot-dash line R indicates the position where the capstan rollers 104 convey the print sheet 106.

First, the print sheet 106 is conveyed to the starting position for printing in the direction of (1).

Next, an image is printed in the direction of (2).

After that, the print sheet 106 is conveyed to the position where its forward end is to be cut, in the direction of (3).

Then, the forward end of the sheet is cut by the cutter member 109 as indicated by (4), and the cut piece is collected by the cut piece collection receptacle 110.

Next, the print sheet 106 is conveyed to the position where its rear end of the sheet is to be cut, in the direction of (5).

Finally, the rear end of the sheet is cut by the cutter member 109 as indicated by (6), and the printed product is then discharged to the exterior of the device in the direction of (7).

In order to simplify the descriptions, only a single instance of the printing process indicated by (2) is illustrated in FIG. 16. However, as described earlier, in actual color printing, the print sheet 106 makes multiple passes during the printing process of (2), whereby colors are overlapped. In addition to the three colors of yellow, magenta, and cyan, black or a protective overcoat layer on the print surface are also normally transferred, and thus the print operations are performed across three to five passes.

In this conventional example, when the cut pieces accumulate within the cut piece collection receptacle 110, the user must discard those cut pieces. Several proposals have been made for improving the operations performed by the user for discarding the cut pieces (for example, Japanese Patent Laid-Open No. 2001-163459 and Japanese Patent Laid-Open No. 2002-226096).

However, these techniques, too, ultimately provide no substitute for the user discarding the cut pieces that have accumulated in the cut piece collection receptacle 110 by hand, and thus there has been no change in the decrease in usability. Meanwhile, a configuration that puts to use the latest highly-accurate sensors and a paper conveyance mechanism, thereby eliminating the occurrence of cut pieces, has been proposed (for example, Japanese Patent Laid-Open No. 2002-103286).

FIG. 17 is a diagram illustrating the operations performed using a configuration that eliminates the occurrence of cut pieces, contrasted to those of FIG. 16.

As shown in FIG. 17, following the printing indicated by (2), in order to cut the rear end of the sheet in the processes of (5) and (6) with high accuracy, the processes of (3) and (4) in FIG. 16 are omitted. As a result, cut pieces are eliminated. However, even if the print sheet 106 is positioned according to highly-accurate sensing and then cut with the cutter member 109, it is not realistically possible to completely prevent the printed product from being skewed from the cutting line. Therefore, particularly when printing an image with high differences in contrast, such as that shown in FIG. 18A, the result is as shown in FIG. 18B or 18C, resulting in a drop in the image quality.

As described thus far, a conventional printer provided with a cutter for obtaining a printed product printed across the entire surface with the margins removed has two problems. The first problem is that the cut pieces resulting from the cutter must be discarded by the user, leading to a decrease in the usability. The second problem is that even if highly-accurate cutting that does not result in cut pieces is implemented, a slight portion of the previous or following image will remain on the primary image, leading to a drop in image quality when such an artifact is apparent.

SUMMARY OF THE INVENTION

The present invention has been made in consideration of the above-described problem and to attain, in a printer provided with a cutter for cutting margins, a printing apparatus with high image quality and high usability that cuts margins while at the same time does not require a user to consciously discard the cut pieces.

In order to solve the aforementioned problems, the present invention provides a cartridge that is detachable from a printing apparatus that includes a printing unit that prints onto a print medium and a cutter member that cuts the print medium, the cartridge comprising a print medium containment portion that contains print medium that are consumed along with printing operations performed by the printing unit, a cut piece collection portion that collects cut pieces of the print medium resulting from cutting operations performed by the cutter member are formed integrally in the cartridge and a partition member that separates the print medium containment portion from the cut piece collection portion, wherein the partition member is movable.

Furthermore, the present invention provides a printing apparatus to which the cartridge defined above is detachable, the apparatus comprising a printing unit that prints onto a print medium and a cutter member capable of cutting the print medium.

As a result, the user can perform a process for discarding the cut pieces with certainty simply by replacing the cartridge as per the conventional art, without needing to consciously focus on the discarding process. This added convenience improves the usability far beyond the conventional example, in which the user must discard the cut pieces without forgetting each time.

According to the present invention, in a printing apparatus provided with a cutter for cutting margins and obtaining a printed product, the margins are cut completely, and at the same time, the user is not required to consciously discard the cut pieces. It is therefore possible to realize a printing apparatus with both high image quality and high usability.

In addition to the above effects, it is furthermore possible to reduce the size of the cartridge, the overall printing apparatus, and so on.

Further features of the present invention will become apparent from the following description of an exemplary embodiment (with reference to the attached drawings).

DESCRIPTION OF THE EMBODIMENTS

Hereinafter, embodiments of the present invention shall be described in detail with reference to the appended drawings.

It should be noted that the embodiments described hereinafter are merely exemplary. The embodiments may be modified as appropriate depending on the configuration of the apparatus, the various conditions, and so on to which the present invention is applied; the present invention is not intended to be limited to the embodiments described hereinafter.

Figure 1A:
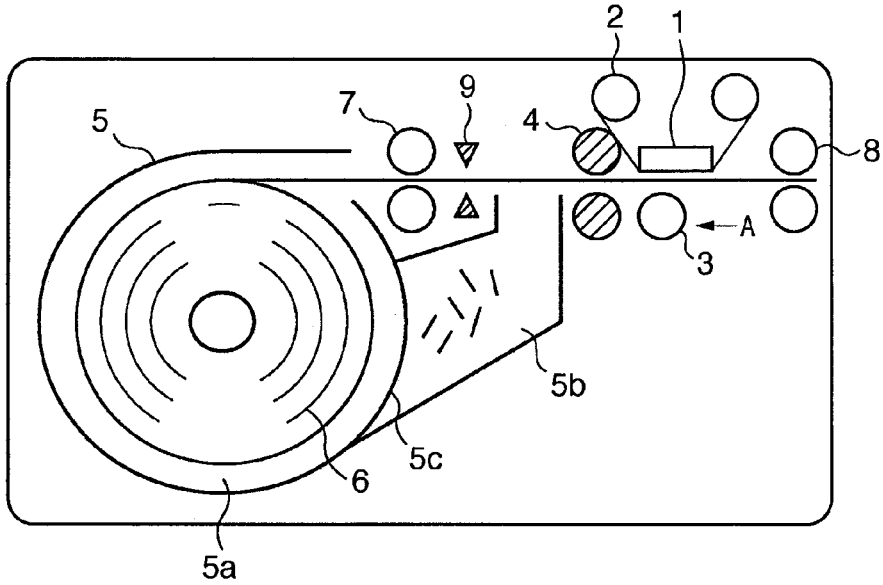
FIG. 1A is a cross-section of a printing apparatus according to a first embodiment of the present invention and FIG. 1B shows an ink sheet in roll form for a printing apparatus according to a first embodiment of the present invention.
Figure 1B:
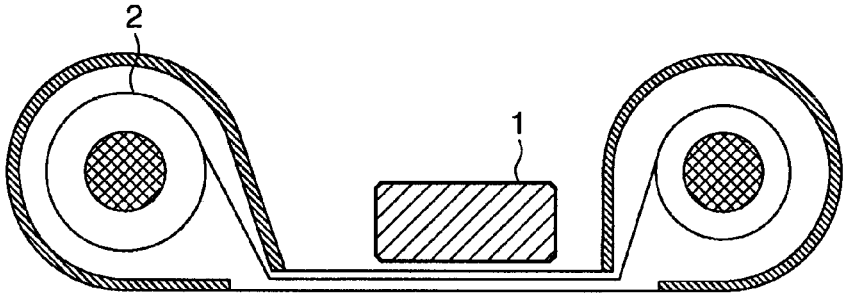

FIG. 1A is a cross-section illustrating a printing apparatus according to a first embodiment of the present invention, provided with a cutter and a print sheet in roll form, conceptually illustrating the printer at an exaggerated scale for the sake of simplicity. FIG. 1B shows an ink sheet in roll form for the printing apparatus according to the first embodiment of the present invention.

In FIGS. 1A and 1B, reference numeral 1 denotes a thermal head in which multiple heaters are arrayed linearly, reference numeral 2 denotes an ink sheet that is coated with an ink layer, reference numeral 3 denotes a platen roller provided opposite to the thermal head 1, and reference numeral 4 denotes capstan rollers, in which a driving roller and a slave roller are provided as a pair. Reference numeral 5 denotes a cartridge housing that is detachable from the printing apparatus, and reference numeral 6 denotes a continuous print sheet, wound in roll form, that is contained in the cartridge housing 5.

The cartridge housing 5 is replaced along with the print sheet 6, which is a consumable item consumed as printing operations are performed. In other words, when the print sheet 6 contained within the cartridge is exhausted, the user removes the used cartridge, replaces it with a new cartridge that contains a sufficient amount of new print sheet 6, and uses the new cartridge. Reference numeral 7 denotes conveyance rollers, in which a driving roller and a slave roller are provided as a pair, and reference numeral 8 denotes discharge rollers, in which a driving roller and a slave roller are provided as a pair. Finally, reference numeral 9 denotes a cutter member capable of cutting the print sheet 6 after printing.

The difference between the printing apparatus according to the first embodiment and that according to the conventional example is that a cut piece collection portion, for collecting the cut pieces of the print sheet 6 that has been cut by the cutter member 9, is configured as a part of the cartridge housing 5 itself.

In FIG. 1, reference numeral 5*a* denotes a print sheet containment portion that is formed in the cartridge housing 5.

Similarly, reference numeral 5*b* denotes a cut piece collection portion formed in the cartridge housing 5, in which the cut pieces cut by the cutter member 9 are collected. Reference numeral 5*c* denotes a partition, composed of an elastic material, that separates the print sheet containment portion 5*a* from the cut piece collection portion 5*b*. In other words, at least part of the print sheet containment portion 5*a*, serving as a consumables containment portion, and the cut piece collection portion 5*b*, are adjacent to one another, with the partition 5*c* therebetween.

With a configuration that utilizes the capstan rollers 4, printing is carried out while conveying the print sheet 6 in the direction from the thermal head 1 toward the capstan rollers 4, or in other words, in the direction of A in FIG. 1. Printing is performed as follows. First, the ink sheet 2 and the print sheet 6 are pressurized between the thermal head 1 and the platen roller 3, whereby heat emitted by the thermal head 1 causes the ink on the ink sheet 2 to be sublimed and thus transferred onto the surface of the print sheet 6. At the same time, the print sheet 6 is conveyed by the pair of capstan rollers 4 provided downstream from the printing direction. In order to print subsequent colors after the first color has been printed, the pressure of the thermal head 1 is released, and the capstan rollers 4 are rotated in the direction opposite to that used during printing, returning the print sheet 6 to the starting position for printing.

The second and subsequent colors are then printed using the same operation as that used for the first color. These printing operations are the same as those of the abovementioned conventional example.

Figure 2:
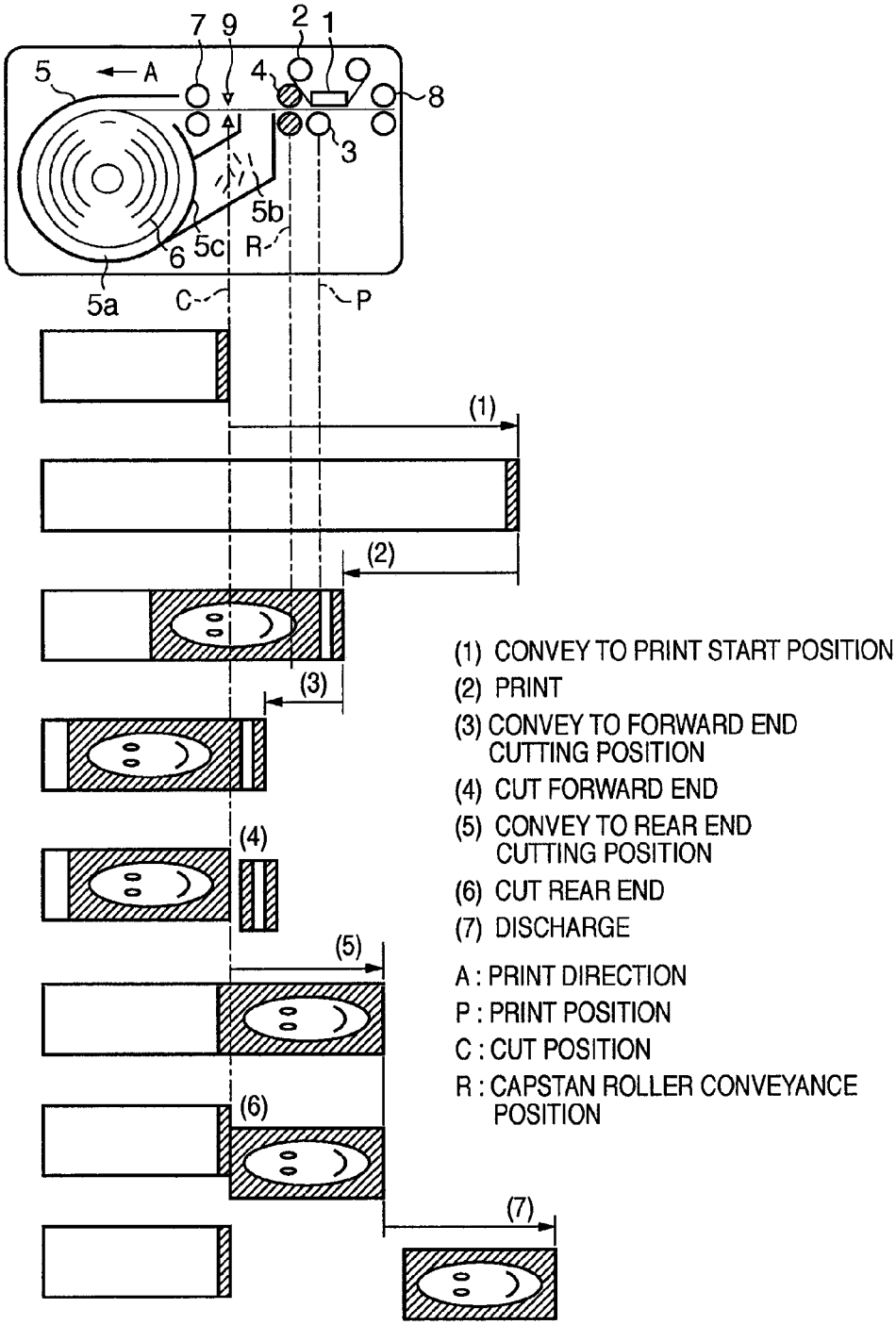
FIG. 2 is a diagram illustrating operations according to the first embodiment of the present invention.

FIG. 2 is a diagram illustrating operations performed by the printing apparatus shown in FIGS. 1A and 1B.

FIG. 2 uses arrows and the numbers (1) through (7) to illustrate the movement of the print sheet 6 throughout the procedure in which the roll-type print sheet 6 is extracted, an image is printed thereupon, and the print sheet 6 is cut and discharged. The dot-dash line P indicates the position where printing is performed; the dot-dash line C indicates the position where the cutter member 9 cuts the print sheet 6; and the dot-dash line R indicates the position where the capstan rollers 4 convey the print sheet 6.

First, the print sheet 6 is conveyed to the starting position for printing in the direction of (1).

Next, an image is printed in the direction of (2).

After that, the print sheet 6 is conveyed to the position where its forward end is to be cut, in the direction of (3).

Then, the forward end of the sheet is cut as indicated by (4), and the cut piece is collected by the cut piece collection portion 5*b*.

Next, the print sheet 6 is conveyed to the position where its rear end of the sheet is to be cut, in the direction of (5).

Finally, the rear end of the sheet is cut by the cutter member 9 as indicated by (6), and the printed product is then discharged to the exterior of the device in the direction of (7).

Because the arrangement of the thermal head 1, which is a printing unit, the capstan rollers 4, which are a conveyance unit, and the cutter member 9, which is a cutting unit, differs between the present embodiment and the conventional example, differences also arise in the amount and direction of conveyance during the operations for conveying the print sheet 6. In order to simplify the descriptions, only a single instance of the printing process indicated by (2) is illustrated in FIG. 2. However, as described earlier, in actual color printing, the print sheet 6 makes multiple passes during the printing process of (2), whereby colors are overlapped. In addition to the three colors of yellow, magenta, and cyan, black or a protective overcoat layer on the print surface are also normally transferred, and thus the print operations are performed across three to five passes.

Figure 3:
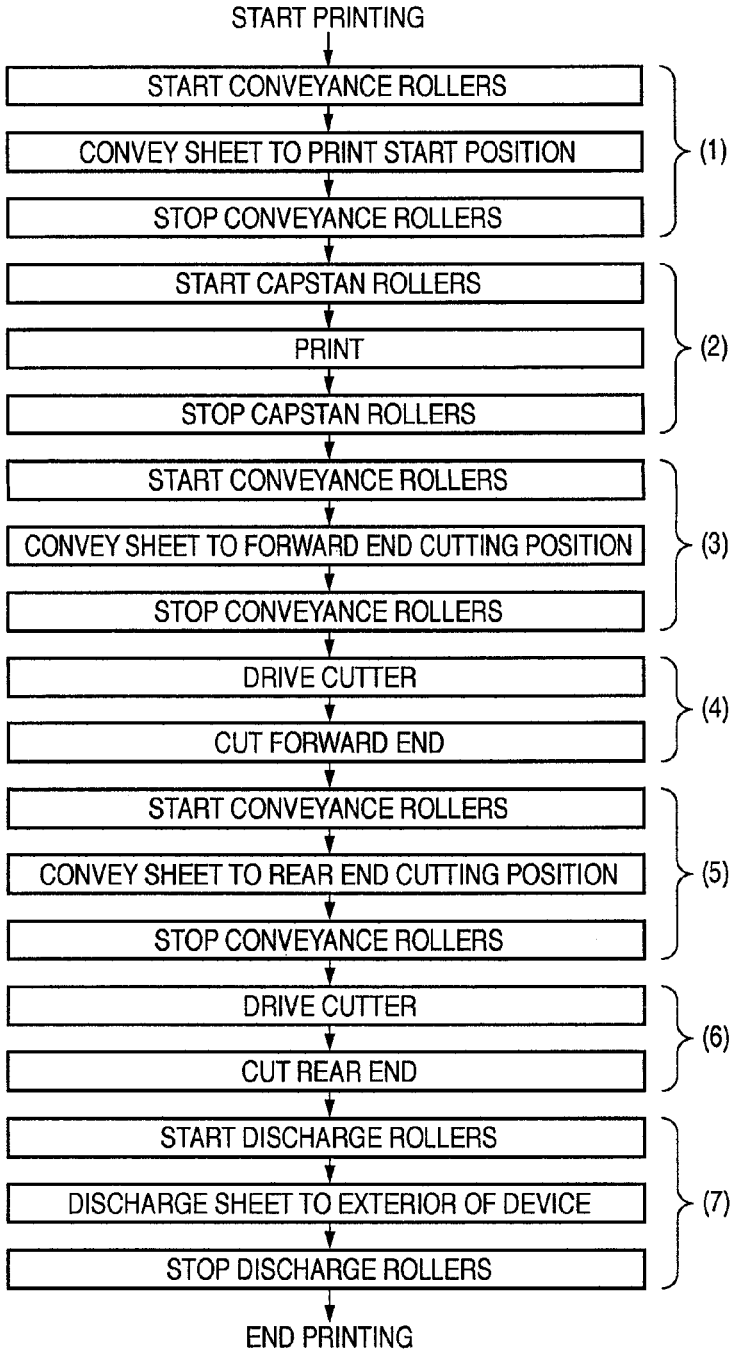
FIG. 3 is a flowchart illustrating operations of a printing apparatus according to the first embodiment of the present invention.

FIG. 3 is a flowchart that sums up the operations performed by the printer as illustrated in FIG. 2. The numbers (1) to (7) on the right side of FIG. 3 correspond to the numbers (1) to (7) in FIG. 2. For the sake of simplicity, only a single instance of the printing process is illustrated in FIG. 3. However, as described with reference to FIG. 2, in actual color printing, the print sheet 6 makes multiple passes during the printing process of (2), whereby colors are overlapped.

Hereinafter, the significant improvement over the conventional example in terms of usability with respect to the operation for discarding cut pieces shall be described as an effect of the present embodiment.

As described with reference to FIGS. 1A and 1B, according to the cartridge of the printing apparatus of the present embodiment, the print sheet containment portion 5*a* and the cut piece collection portion 5*b* are integrated.

At this time, the roll-type print sheet 6 is wound for a predetermined number of sheets is wound, and thus it is possible to accurately estimate, in advance, the amount of cut pieces that will result from executing a predetermined number of prints. Securing a large enough capacity in the cut piece collection portion 5*b* with respect to this estimated amount makes it possible to ensure that all the cut pieces can be collected in the cut piece collection portion 5*b* even if the entire print sheet roll is used up. Removing the cartridge for which the print sheet has been exhausted, replacing it with a new cartridge containing a sufficient amount of the print sheet, and using the printer entails the same operation as with the conventional example.

However, the integrated cut piece collection portion 5*b* can be replaced during the cartridge replacement operation, and thus as a result, the user can perform the process for discarding the cut pieces with certainty, without needing to consciously focus on the discarding process.

As described thus far, the cartridge is formed with the print sheet containment portion 5*a* and the cut piece collection portion 5*b* formed integrally, and a sufficiently large capacity is secured in the cut piece collection portion 5*b* based on the estimated amount of cut pieces resulting from printing the entire print sheet contained within the cartridge. As a result, the user can perform a process for discarding the cut pieces with certainty simply by replacing the cartridge to replace the print sheet as per the conventional art, without needing to consciously focus on the discarding process at all. This added convenience improves the usability far beyond the conventional example, in which the user must discard the cut pieces without forgetting each time.

Although not shown in FIGS. 1 and 2, a configuration that prevents the cut pieces from falling out of the cut piece collection portion 5*b* of the cartridge is necessary for when the cartridge is removed.

Figure 4A:
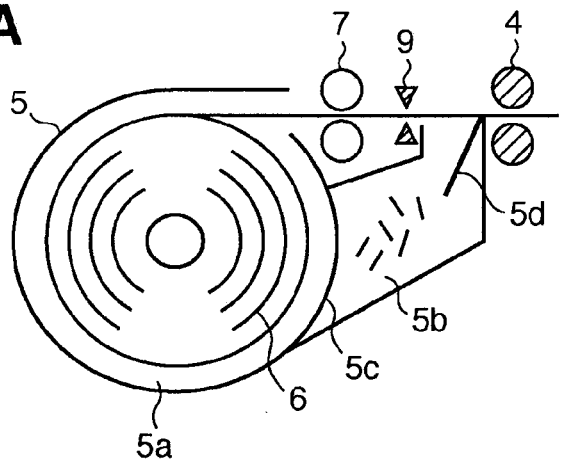
FIGS. 4A to 4C are diagrams illustrating, in detail, a cartridge portion according to the first embodiment of the present invention.

FIG. 4A illustrates an example in which a closeable lid 5*d* has been provided. If a mechanism for opening the lid 5*d* when the cartridge is inside the printing apparatus and closing the lid 5*d* when the cartridge is removed from the printing apparatus is added, it is possible to prevent the cut pieces from falling out when the cartridge is removed.

Figure 4B:
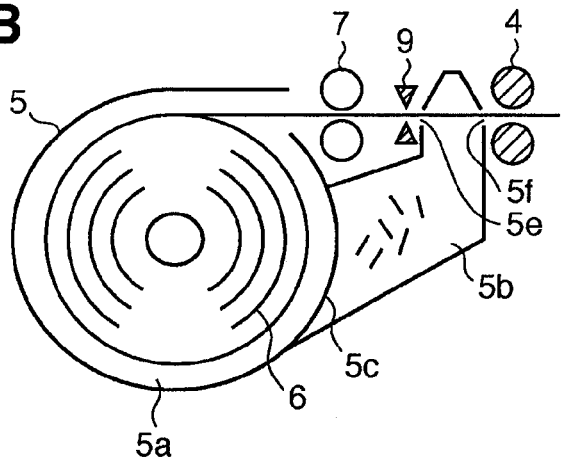
Figure 4C:
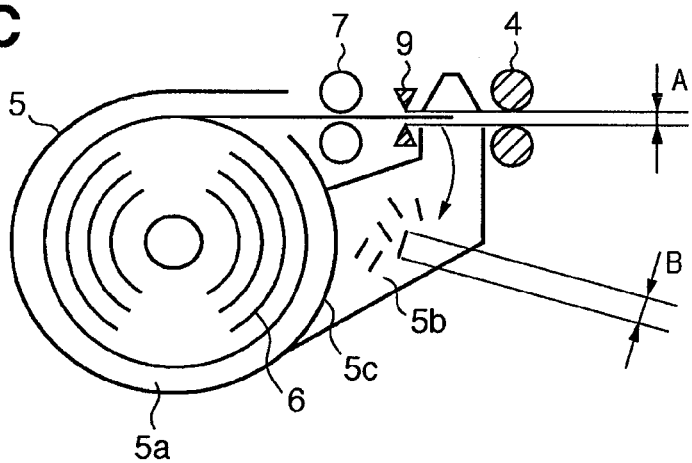

FIGS. 4B and 4C are examples of a configuration that prevents the cut pieces from falling out when the cartridge is removed without adding extra components.

In FIGS. 4B and 4C, 5*e* and 5*f* denote apertures provided in the cartridge housing 5. The dimensions of the apertures 5*e* and 5*f* in the longer side direction are longer than the dimensions of the widthwise direction of the print sheet 6, and thus the print sheet 6 can pass therethrough. When cutting the print sheet 6, the cutting operation is performed with the forward end that is to be cut having entered into the cut piece collection portion 5*b* as shown in FIG. 4C, and thus the cut pieces fall into the cut piece collection portion 5*b* under their own weight. Here, the dimensions of the shorter side direction of the apertures 5*e* and 5*f* (the height dimension A in FIG. 4C) is shorter than the length of the shorter side direction of the cut pieces (the dimension B in FIG. 4C), and therefore cut pieces that have been collected in the cut piece collection portion 5*b* will not fall out again. Even with such a simple configuration, it is possible to prevent the cut pieces from falling out when the cartridge has been removed.

Figure 5:
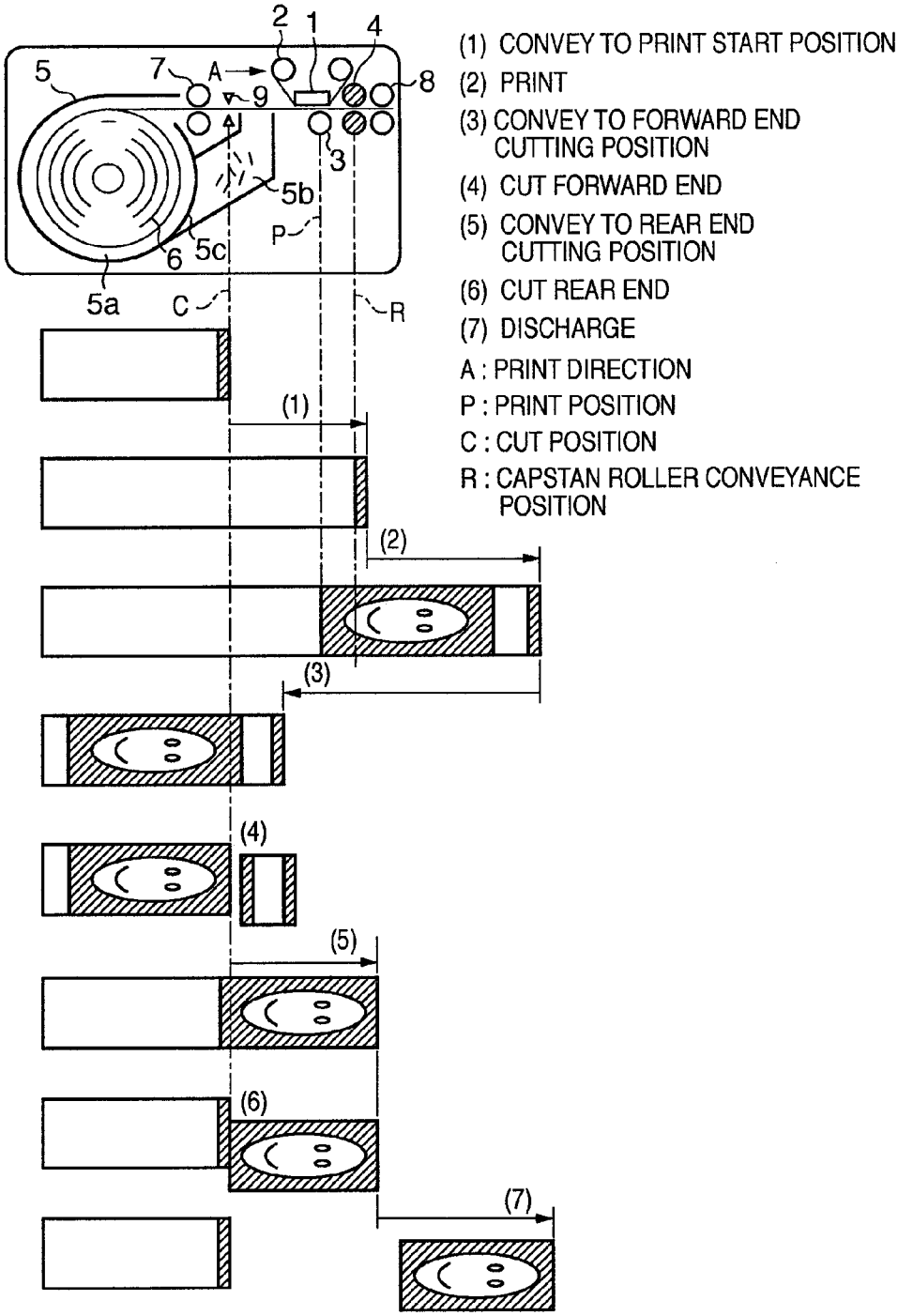
FIG. 5 is a diagram illustrating operations performed by a printing apparatus according to the first embodiment of the present invention when printing in the reverse direction.

Finally, the cutter member 9 and the thermal head 1 are disposed in that order, along the direction moving away from the print sheet containment portion 5*a*, in the printing apparatus according to the present embodiment, and printing is performed in the direction following the print sheet 6 being pulled into the print sheet containment portion 5*a*. It is also possible, however, for the cutter member 9 and the thermal head 1 to be disposed in that order, along the direction moving away from the print sheet containment portion 5*a*, as shown in FIG. 2, but with the printing being performed in the direction following the print sheet 6 being pulled out of the print sheet containment portion 5*a*, opposite that shown in FIG. 2. FIG. 5 illustrates such an operation.

Second Embodiment

Figure 6:
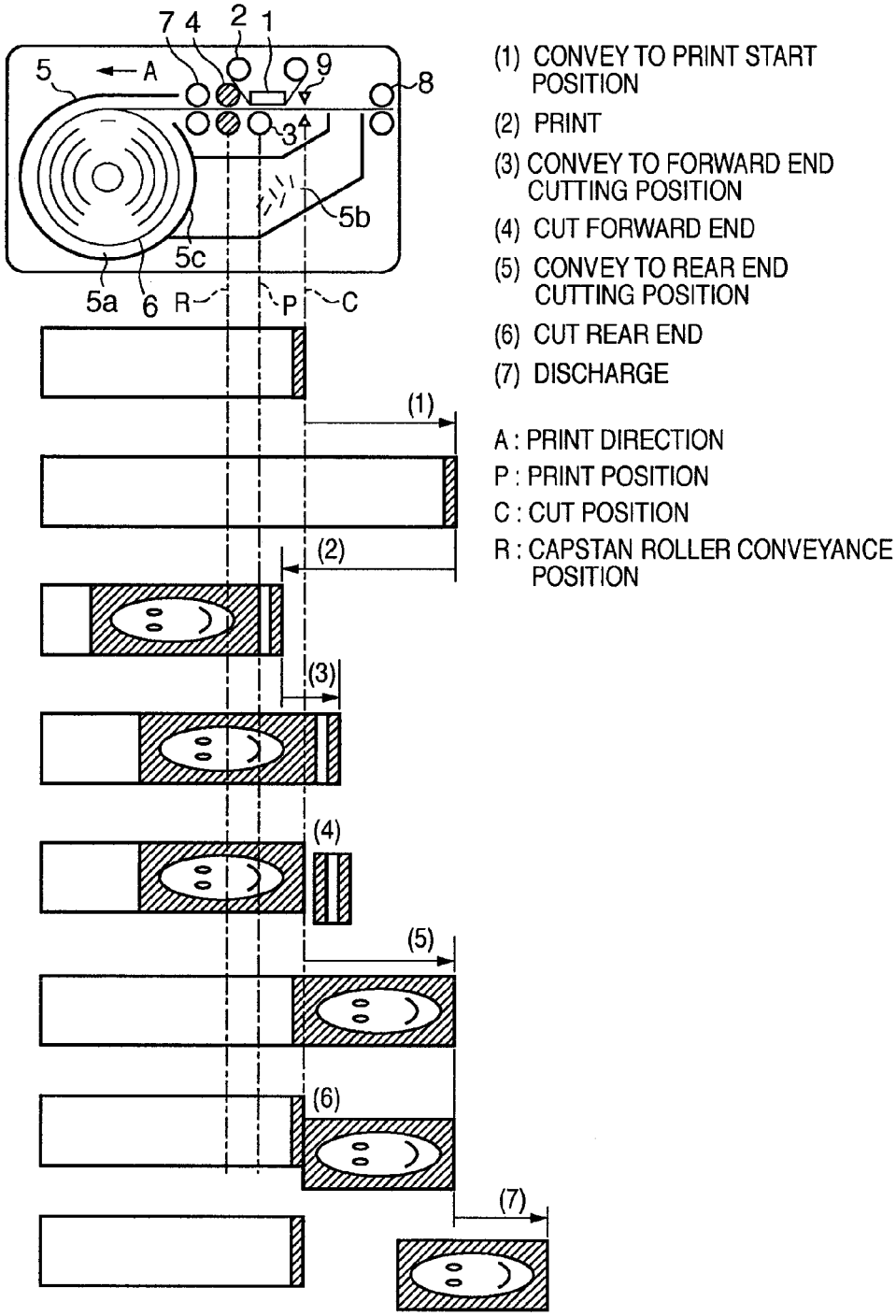
FIG. 6 is a diagram illustrating operations performed by a printing apparatus according to a second embodiment of the present invention.

FIG. 6 is a cross-section illustrating a printing apparatus according to a second embodiment of the present invention, provided with a cutter and a print sheet in roll form, conceptually illustrating the printer at an exaggerated scale for the sake of simplicity.

In the first embodiment (FIG. 2), the cutter member 9 and the thermal head 1 are disposed in that order, along the direction moving away from the print sheet containment portion 5*a*. As opposed to this, in the second embodiment (FIG. 6), the thermal head 1 and the cutter member 9 are disposed in that order, along the direction moving away from the print sheet containment portion 5*a*. The rest of the configuration is the same as in the first embodiment.

With such an arrangement, the print sheet containment portion 5*a* and the cut piece collection portion 5*b* are separated from each other, slightly increasing the size of the cartridge, but a similar effect as that of the first embodiment, whereby the usability is improved, can nevertheless be achieved.

Other points, such as the need for a configuration for preventing the cut pieces from falling back out of the aperture of the cut piece collection portion, the possibility of integrating the cut piece collection portion with the cartridge housing 5, and so on are the same as in the first embodiment.

Figure 7:
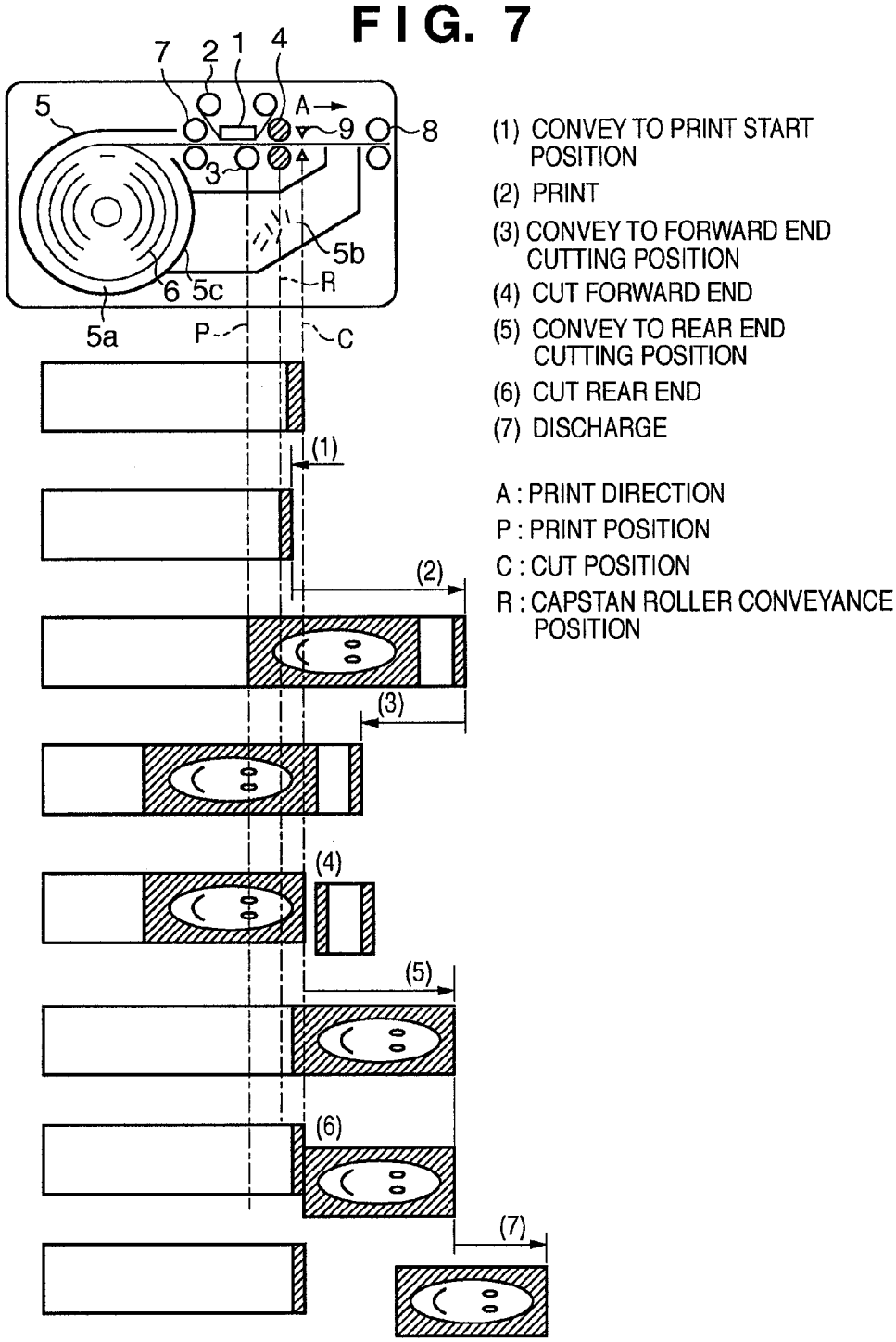
FIG. 7 is a diagram illustrating operations performed by a printing apparatus according to the second embodiment of the present invention when printing in the reverse direction.

Finally, the thermal head 1 and the cutter member 9 are disposed in that order, along the direction moving away from the print sheet containment portion 5*a*, in the printing apparatus according to the present embodiment, and printing is performed in the direction following the print sheet 6 being pulled into the print sheet containment portion 5*a*. It is also possible, however, for the thermal head 1 and the cutter member 9 to be disposed in that order, along the direction moving away from the print sheet containment portion 5*a*, as shown in FIG. 6, but with the printing being performed in the direction following the print sheet 6 being pulled out of the print sheet containment portion 5*a*, opposite that shown in FIG. 6. FIG. 7 illustrates such an operation.

Third Embodiment

Figure 8:
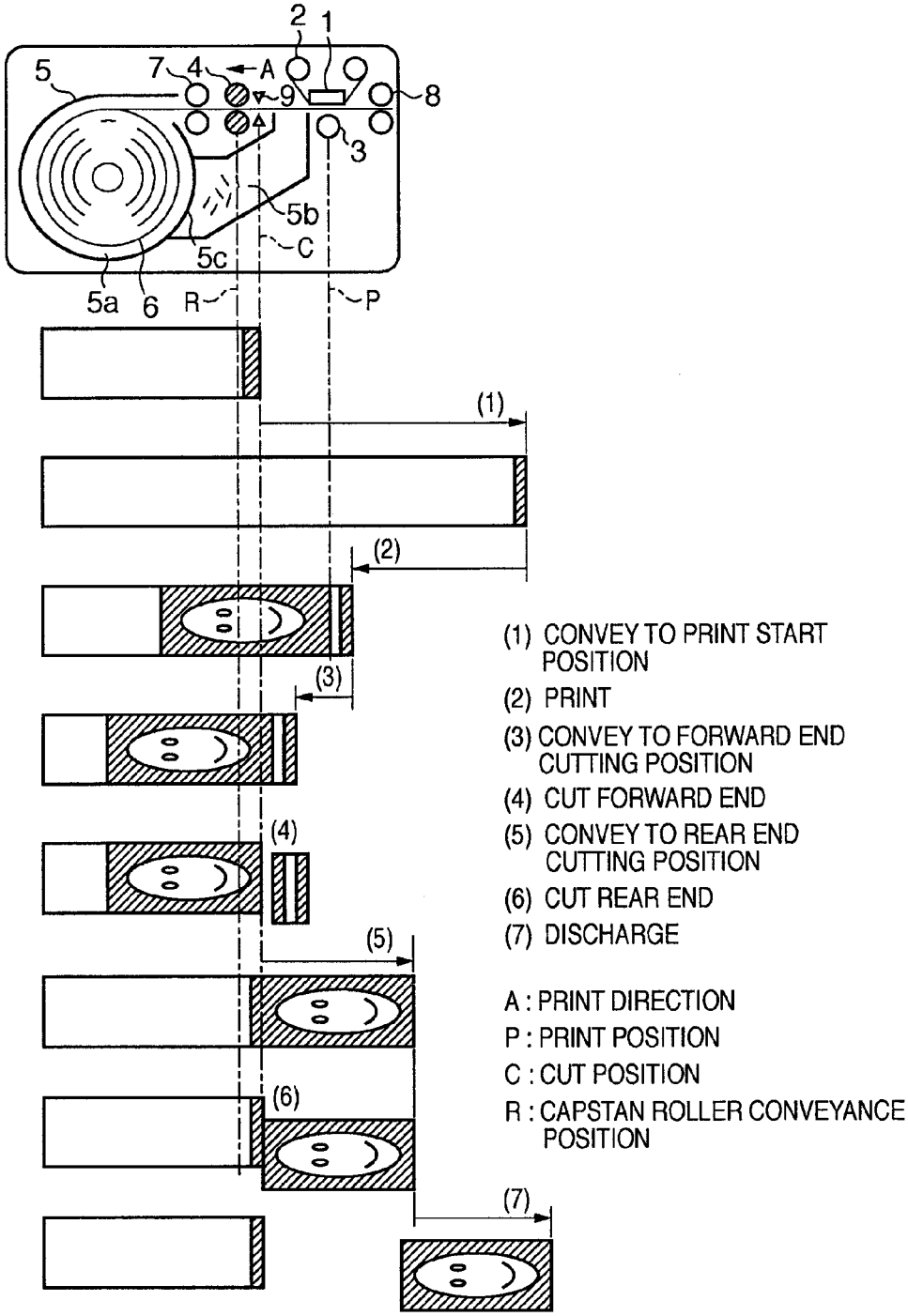
FIG. 8 is a diagram illustrating operations performed by a printing apparatus according to a third embodiment of the present invention.

FIG. 8 is a cross-section illustrating a printing apparatus according to a third embodiment of the present invention, provided with a cutter and a print sheet in roll form, conceptually illustrating the printer on an exaggerated scale for the sake of simplicity.

In the first embodiment (FIGS. 2 and 5) and the second embodiment (FIGS. 6 and 7), the thermal head 1 and the capstan roller 4 are disposed adjacent to each other.

As opposed to this, in the third embodiment (FIG. 8), the cutter member 9 is disposed between the thermal head 1 and the capstan rollers 4. The rest of the configuration is the same as in the first embodiment.

A similar effect as that of the first embodiment, whereby the usability is improved, can be achieved with such an arrangement as well.

Other points, such as the need for a configuration for preventing the cut pieces from falling back out of the aperture of the cut piece collection portion, the possibility of integrating the cut piece collection portion 5*b* with the cartridge housing 5, and so on are the same as in the first embodiment.

Figure 9:
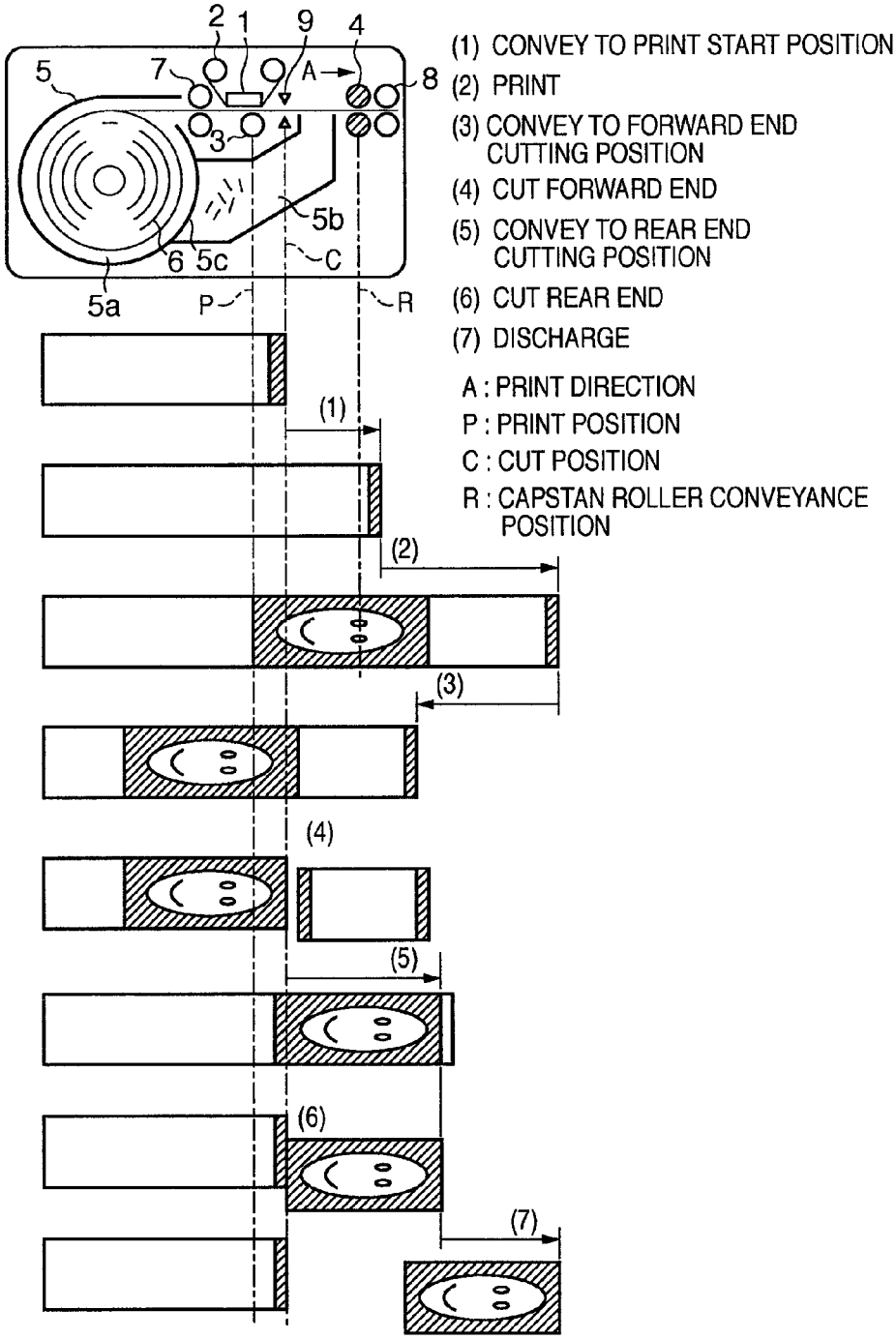
FIG. 9 is a diagram illustrating operations performed by a printing apparatus according to the third embodiment of the present invention when printing in the reverse direction.

Finally, the cutter member 9 is disposed between the thermal head 1 and the capstan rollers 4 in the printing apparatus according to the present embodiment, and printing is performed in the direction following the print sheet 6 being pulled into the print sheet containment portion 5*a*. It is also possible, however, for the cutter member 9 to be disposed between the thermal head 1 and the capstan rollers 4 as shown in FIG. 8, but with the printing being performed in the direction following the print sheet 6 being pulled out of the print sheet containment portion 5*a*, opposite that shown in FIG. 8. FIG. 9 illustrates such an operation. Note that the configuration shown in FIG. 9 does have a disadvantage in that the cut pieces are large in size, but the same effects as in the first and second embodiments can be achieved as long as the cut piece collection portion 5*b* can be made large enough.

Fourth Embodiment

Figure 10:
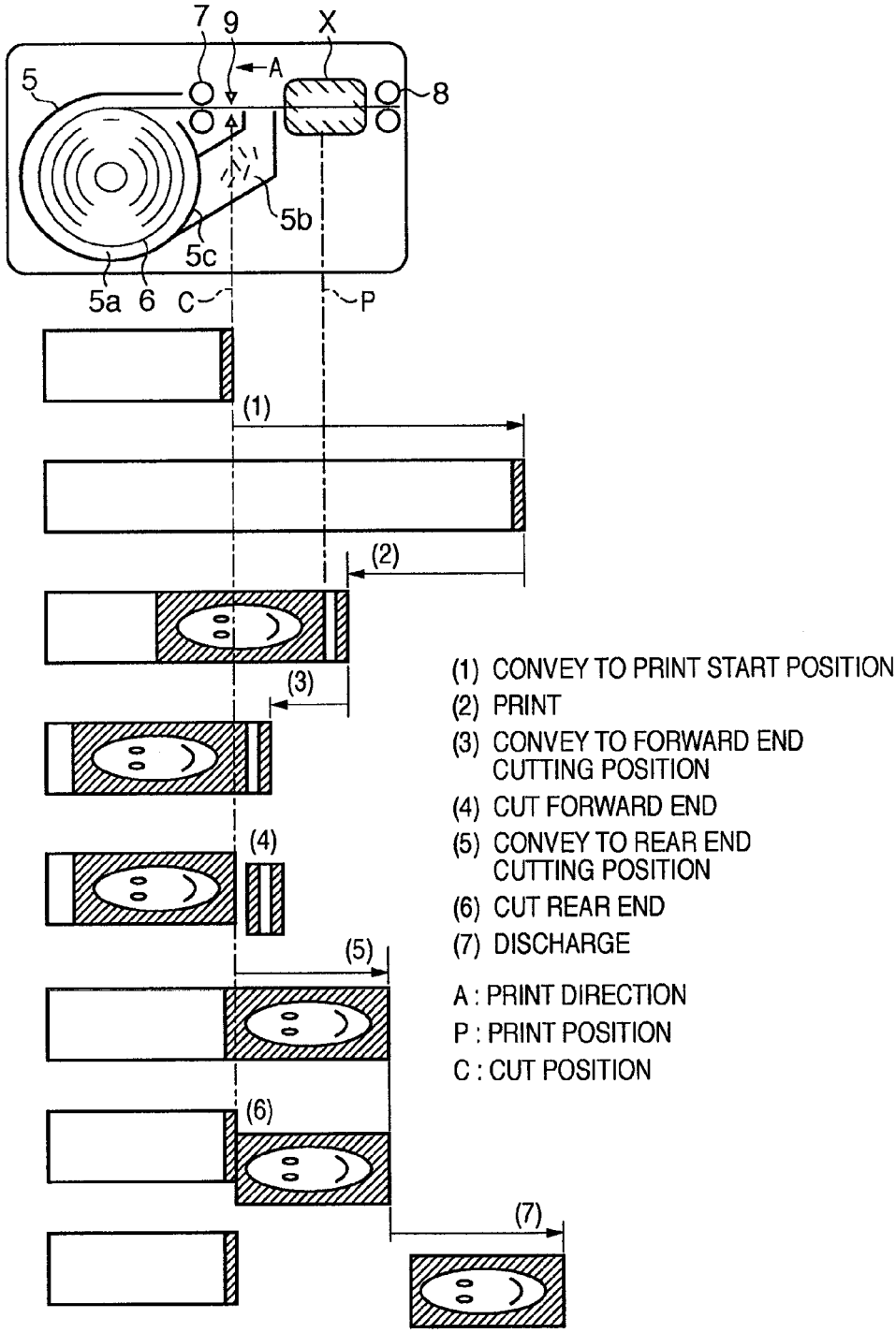
FIG. 10 is a diagram illustrating operations performed by a printing apparatus according to a fourth embodiment of the present invention.

FIG. 10 is a cross-section illustrating a printing apparatus according to a fourth embodiment of the present invention, provided with a cutter and a print sheet in roll form, conceptually illustrating the printer at an exaggerated scale for the sake of simplicity.

The first through third embodiments are examples of thermal printers utilizing thermal heads. As opposed to this, the fourth embodiment (FIG. 10) is an example of a printer configuration that uses a different printing technique. The hatched portion X in FIG. 10 denotes a printing unit that is not limited to any particular technique, and the rest of the configuration is the same as that in the first embodiment. A similar effect as that of the first embodiment, whereby the usability is improved, can be achieved with such an arrangement as well.

The need for a configuration for preventing the cut pieces from falling back out of the aperture of the cut piece collection portion is the same as in the first embodiment.

Figure 11:
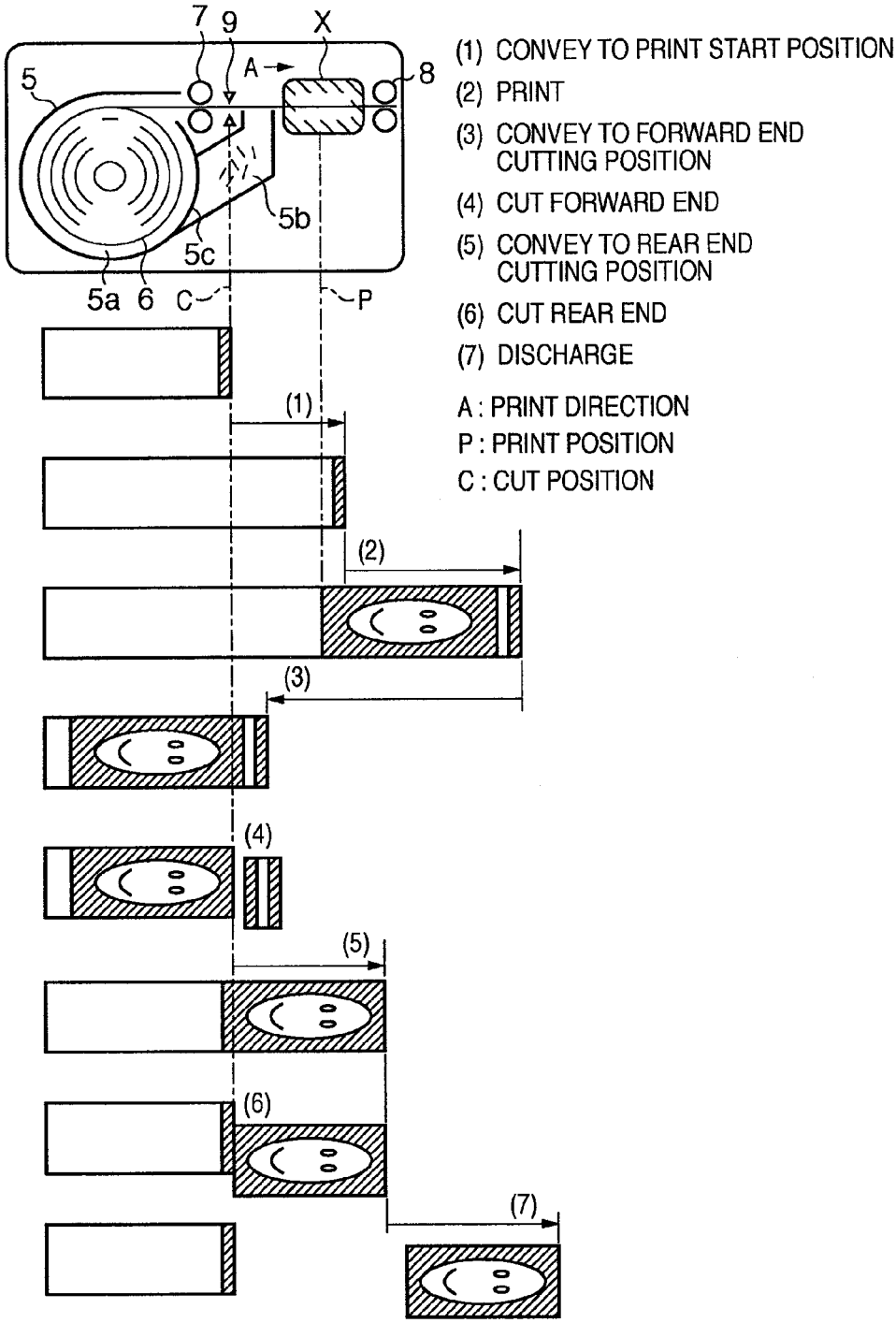
FIG. 11 is a diagram illustrating operations performed by a printing apparatus according to the fourth embodiment of the present invention when printing in the reverse direction.

Finally, the cutter member 9 and the printing unit X are disposed in that order, along the direction moving away from the print sheet containment portion 5*a*, in the printing apparatus according to the present embodiment, and printing is performed in the direction following the print sheet 6 being pulled into the print sheet containment portion 5*a*. It is also possible, however, for the cutter member 9 and the printing unit X to be disposed in that order, along the direction moving away from the print sheet containment portion 5*a*, as shown in FIG. 10, but with the printing being performed in the direction following the print sheet being pulled out of the print sheet containment portion 5*a*, opposite that shown in FIG. 10. FIG. 11 illustrates such an operation.

Fifth Embodiment

Figure 12:
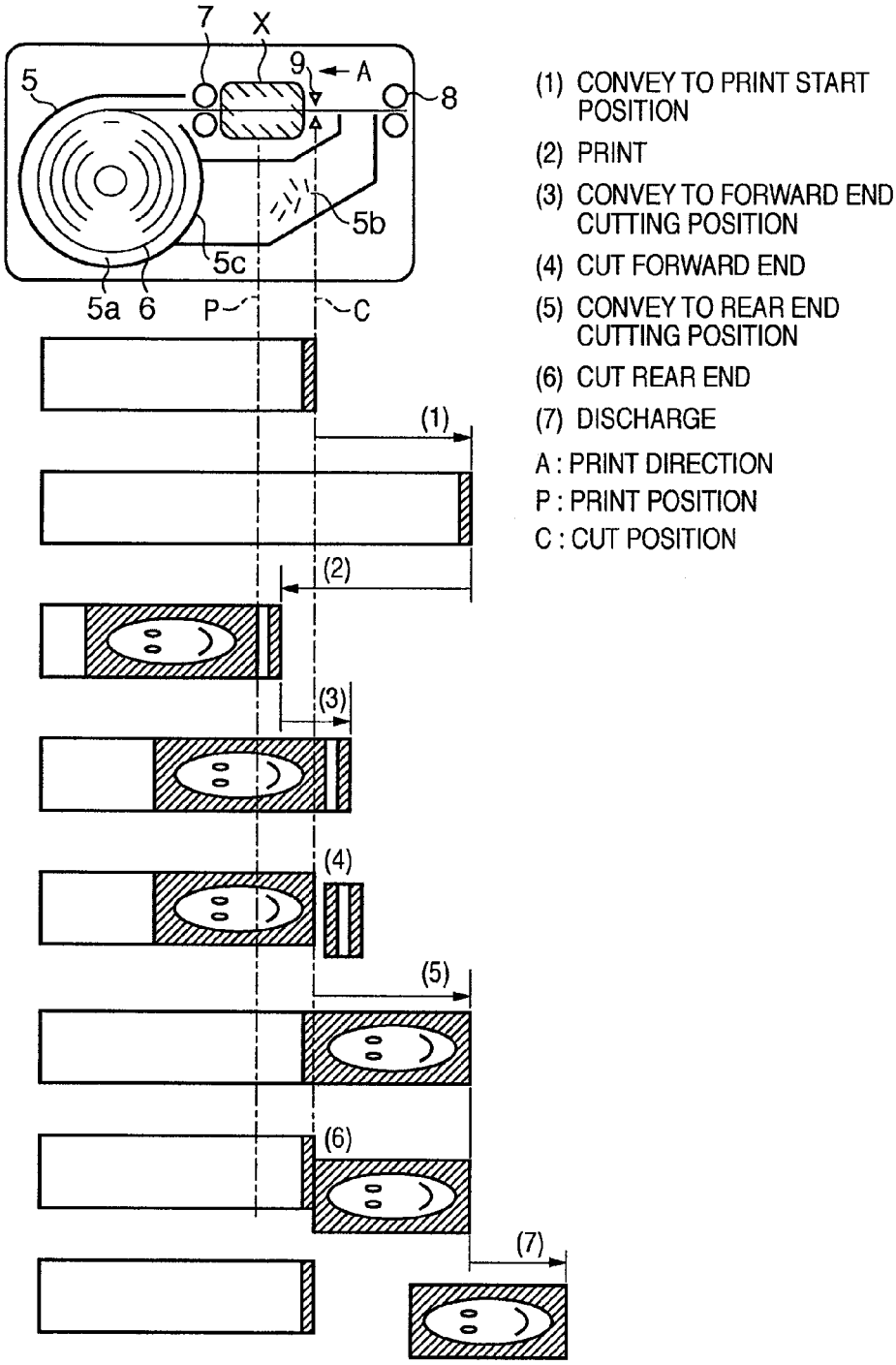
FIG. 12 is a diagram illustrating operations performed by a printing apparatus according to a fifth embodiment of the present invention.

FIG. 12 is a cross-section illustrating a printing apparatus according to a fifth embodiment of the present invention, provided with a cutter and a print sheet in roll form, conceptually illustrating the printer at an exaggerated scale for the sake of simplicity.

In the fourth embodiment (FIG. 10), the cutter member 9 and the printing unit X are disposed in that order, along the direction moving away from the print sheet containment portion 5*a*. As opposed to this, in the fifth embodiment (FIG. 12), the printing unit X and the cutter member 9 are disposed in that order, along the direction moving away from the print sheet containment portion 5*a*. The rest of the configuration is the same as that in the fourth embodiment.

With such an arrangement, the print sheet containment portion 5*a* and the cut piece collection portion 5*b* are separated from each other, slightly increasing the size of the cartridge, but a similar effect as that of the first embodiment, whereby the usability is improved, can nevertheless be achieved.

The need for a configuration for preventing the cut pieces from falling back out of the aperture of the cut piece collection portion 5*b* is the same as in the first embodiment.

Figure 13:
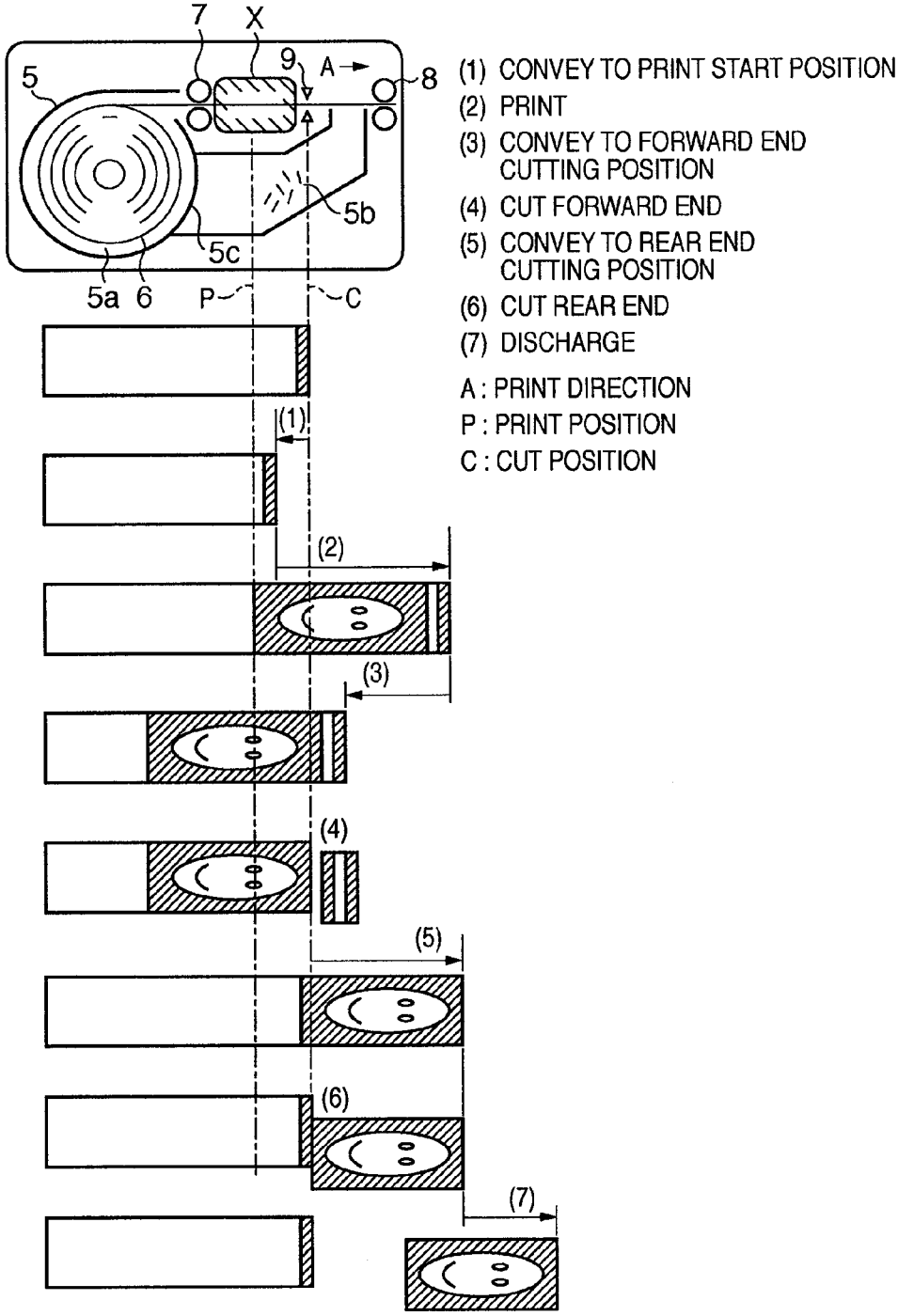
FIG. 13 is a diagram illustrating operations performed by a printing apparatus according to the fifth embodiment of the present invention when printing in the reverse direction.

Finally, the printing unit X and the cutter member 9 are disposed in that order, along the direction moving away from the print sheet containment portion 5*a*, in the printing apparatus according to the present embodiment, and printing is performed in the direction following the print sheet 6 being pulled into the print sheet containment portion 5*a*. It is also possible, however, for the printing unit and the cutter member 9 to be disposed in that order, along the direction moving away from the print sheet containment portion 5*a*, as shown in FIG. 12, but with the printing being performed in the direction following the print sheet 6 being pulled out of the print sheet containment portion 5*a*, opposite that shown in FIG. 12. FIG. 13 illustrates such an operation.

Sixth Embodiment

Figure 14A:
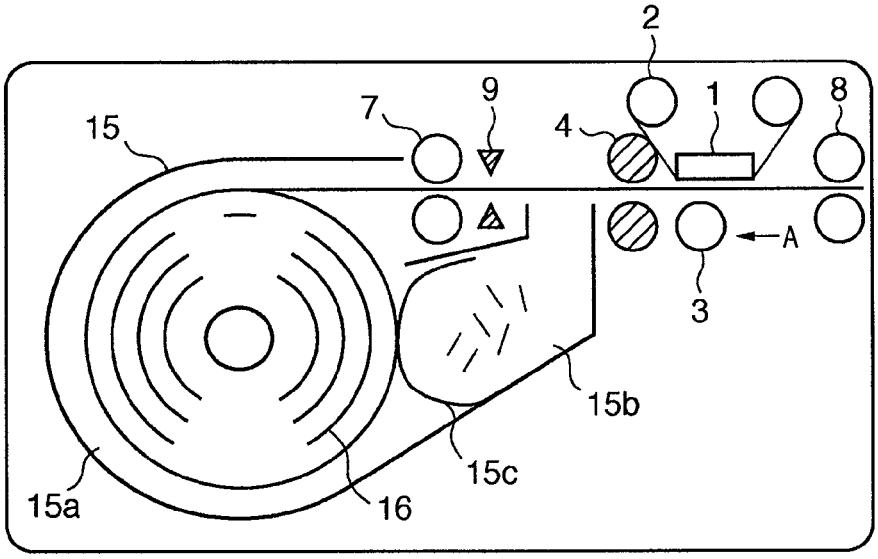
FIGS. 14A and 14B are cross-sections of a printing apparatus according to a sixth embodiment of the present invention.
Figure 14B:
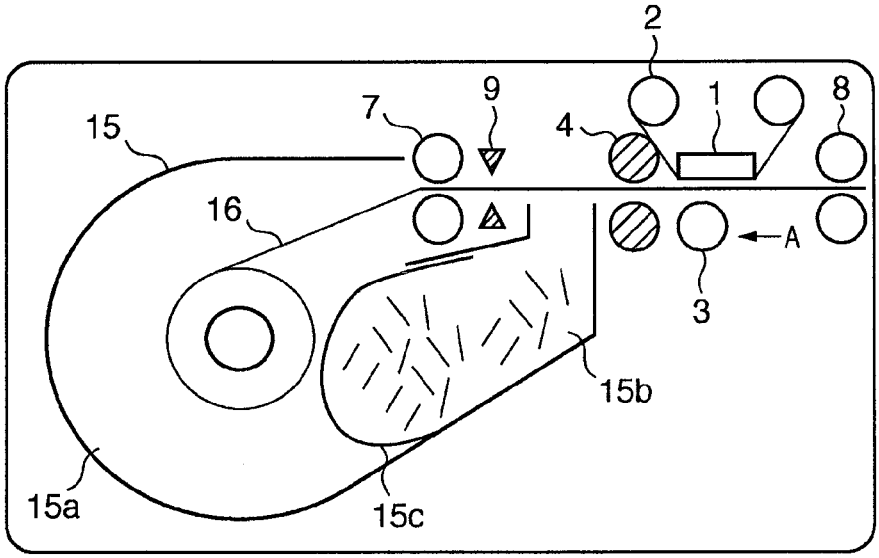

FIGS. 14A and 14B are cross-sections illustrating a printing apparatus according to a sixth embodiment of the present invention, provided with a cutter and a print sheet in roll form, conceptually illustrating the printer at an exaggerated scale for the sake of simplicity. Elements identical to those of the first embodiment are given identical reference numerals, and descriptions thereof shall be omitted.

In FIGS. 14A and 14B, reference numeral 15 denotes a cartridge housing that is detachable from the printing apparatus. Reference numeral 16 denotes a continuous print sheet, wound in roll form, that is contained in the cartridge housing 15. Reference numeral 9 denotes a cutter member capable of cutting the print sheet in roll form. The cartridge housing 15 is a consumable item replaced along with the print sheet 16.

In other words, when the print sheet 16 contained within the cartridge housing 15 is exhausted, the user removes the used cartridge, replaces it with a new cartridge that contains a sufficient amount of new print sheet, and uses the new cartridge. Reference numeral 15*a* denotes a print sheet containment portion that is formed in the cartridge housing 15. Similarly, reference numeral 15*b* denotes a cut piece collection portion formed in the cartridge housing 15, in which the cut pieces cut by the cutter member 9 are collected. Reference numeral 15*c* denotes a partition, composed of an elastic material, that separates the print sheet containment portion 15*a* from the cut piece collection portion 15*b*. In other words, at least part of the print sheet containment portion 15*a*, serving as a consumables containment portion, and the cut piece collection portion 15*b*, are adjacent to one another, the partition 15*c* therebetween.

The difference between the printing apparatus of the present embodiment and that of the first through fifth embodiments is that the partition 15*c* that separates the print sheet containment portion 15*a* from the cut piece collection portion 15*b* is formed of an elastic member. A characteristic of the present embodiment is that the partition 15*c* is installed in the cartridge housing 15 in a state in which it is undergoing elastic deformation, and the restoring force of the partition 15*c* resulting from the elastic deformation works in the direction from the cut piece collection portion 15*b* toward the print sheet containment portion 15*a*.

FIG. 14A illustrates a state immediately following the start of the use of the cartridge, whereas FIG. 14B illustrates a state immediately prior to the cartridge being completely used. As the print sheet 16 in the print sheet containment portion 15*a* decreases, the partition 15*c* that has undergone elastic deformation moves toward the print sheet containment portion 15*a* due to the restoring force caused by the elastic deformation. As a result, the capacity of the cut piece collection portion 15*b* increases. With such a configuration, because the capacity changes as the print sheet 16 decreases and the cut pieces increase and the two therefore offset each other as the cartridge progresses from the start of use to being used up, the space therein can be effectively used. This in turn makes it possible to reduce the size of the cartridge and the size of the printing apparatus.

Other points, such as the need for a configuration for preventing the cut pieces from falling back out of the aperture of the cut piece collection portion 15*b*, the possibility of integrating the cut piece collection portion 15*b* with the cartridge housing 15, and so on are the same as in the first embodiment.

Furthermore, while the arrangement of the thermal head 1, cutter member 9, and capstan rollers 4, the printing directions, and so on of the present embodiment are the same as those in the first embodiment (FIG. 2), combinations with other arrangements, combinations with other printing directions, and so on such as those shown in the first through third embodiments, are also possible.

Furthermore, although the present embodiment described the printing technique as a thermal type utilizing a thermal head, the present invention can also be realized using a different printing technique such as described in the fourth and fifth embodiments.

The present invention can also be applied in a configuration that integrates a housing containing a continuous ink sheet with a housing containing a print sheet. In such a case, the cartridge ultimately integrates a print sheet containment portion, an ink sheet containment portion, and a cut piece collection portion.

Figure 15:
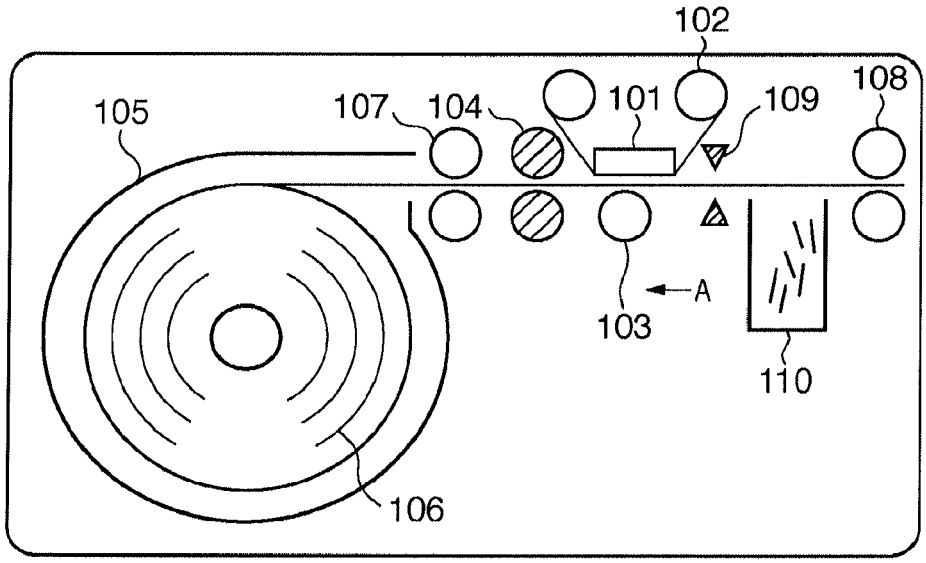
FIG. 15 PRIOR ART
FIG. 15A is a cross-section of a printing apparatus according to a first conventional example and FIG. 15B shows print sheets cut out in advance at a set size for a printing apparatus according to a modified embodiment of the present invention.
Figure 16:
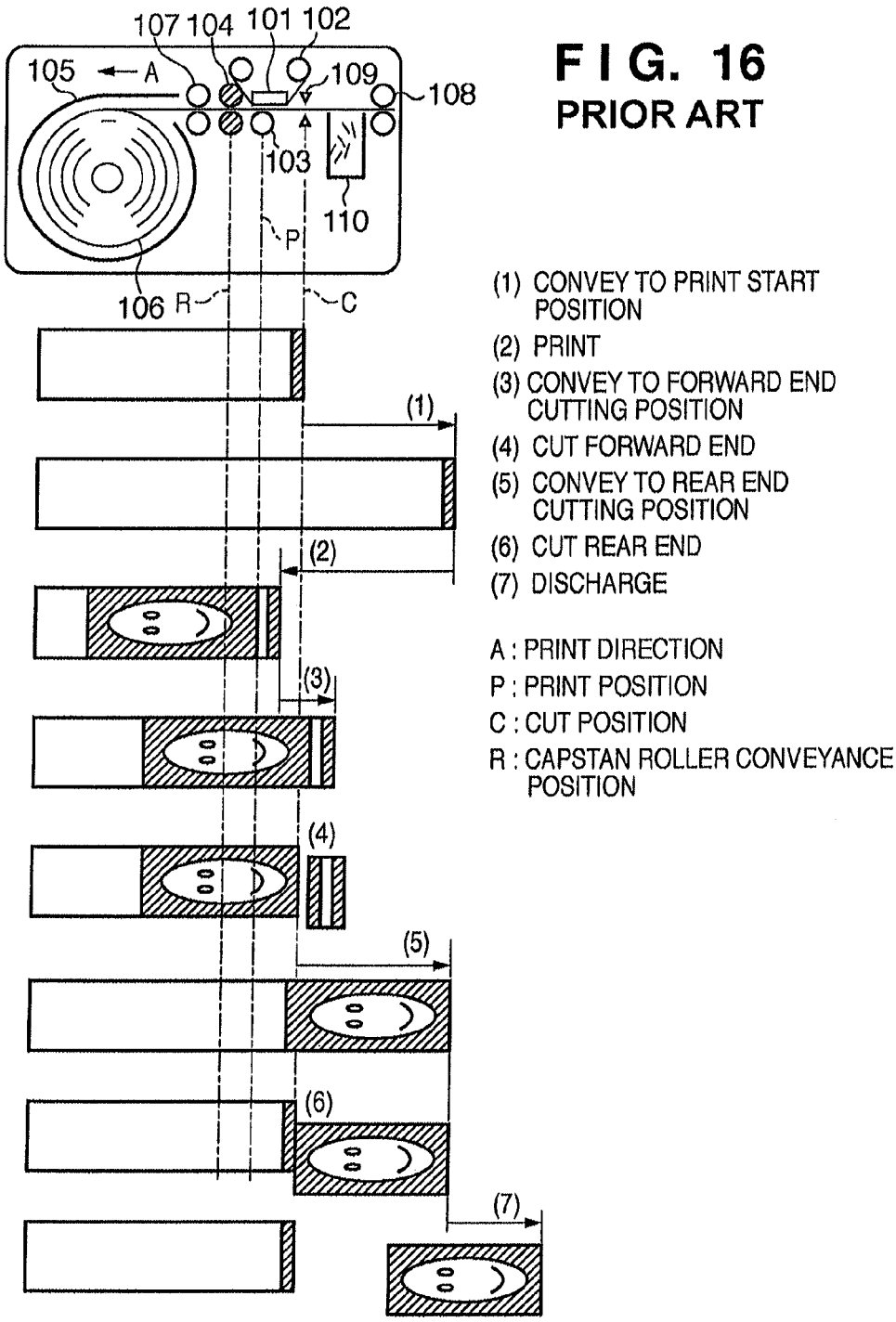
FIG. 16 PRIOR ART
FIG. 16 is a diagram illustrating operations performed by a printing apparatus according to a second conventional example.
Figure 17:
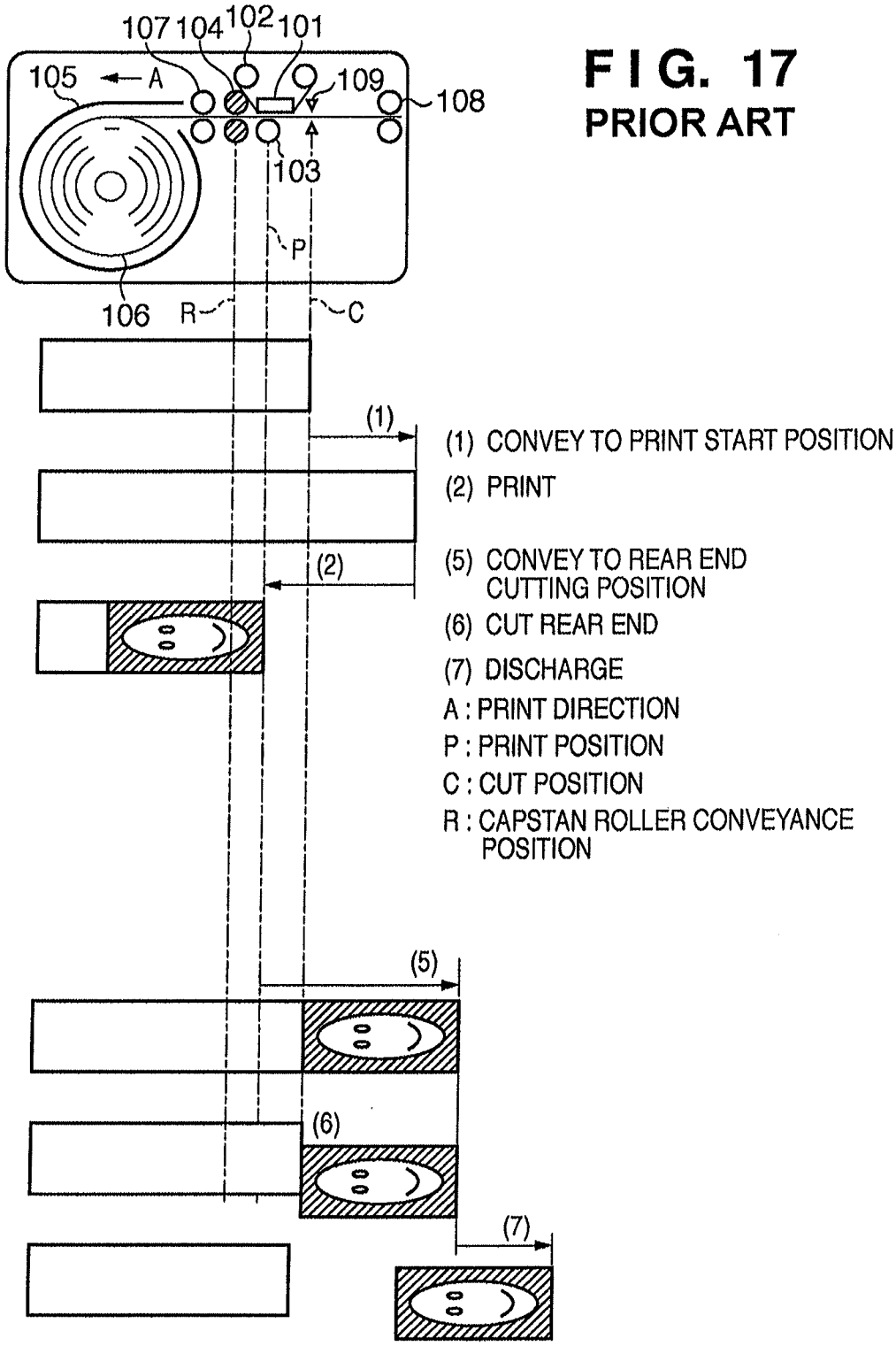
FIG. 17 PRIOR ART
FIG. 17 is another diagram illustrating operations performed by a printing apparatus according to the second conventional example.
Figure 18A:
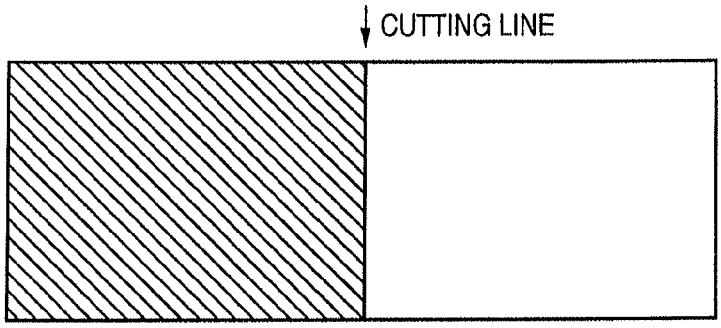
FIG. 18A PRIOR ART
FIGS. 18A to 18C are diagrams illustrating problems with the printing apparatus according to the second conventional example.
Figure 18B:
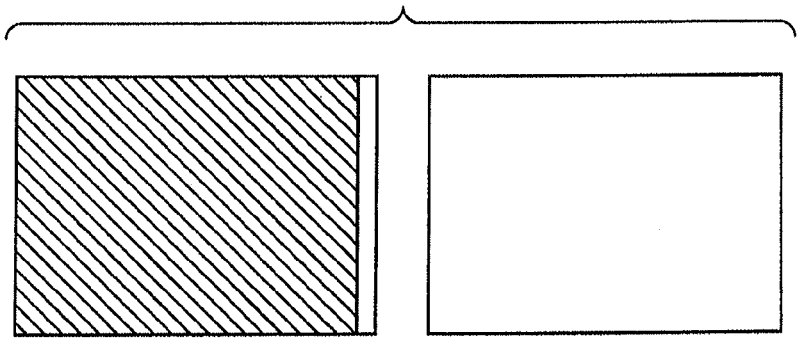
FIG. 18B PRIOR ART
Figure 18C:
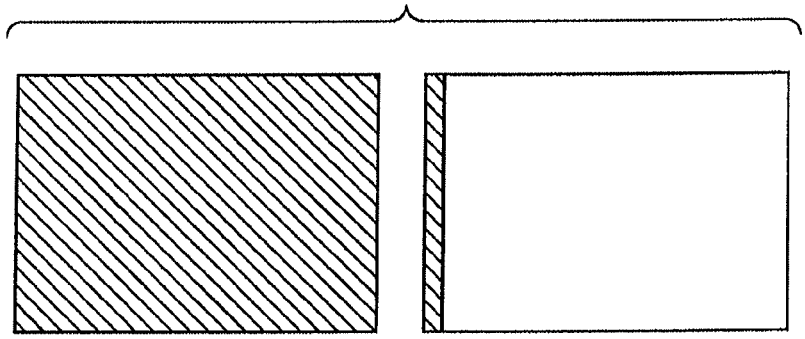
FIG. 18C PRIOR ART

Finally, in addition to roll-type print sheets, the present invention can also be applied to print sheets cut out in advance at a set size and laminated (stacked) as shown in FIG. 15B.

Seventh Embodiment

Figure 19A:
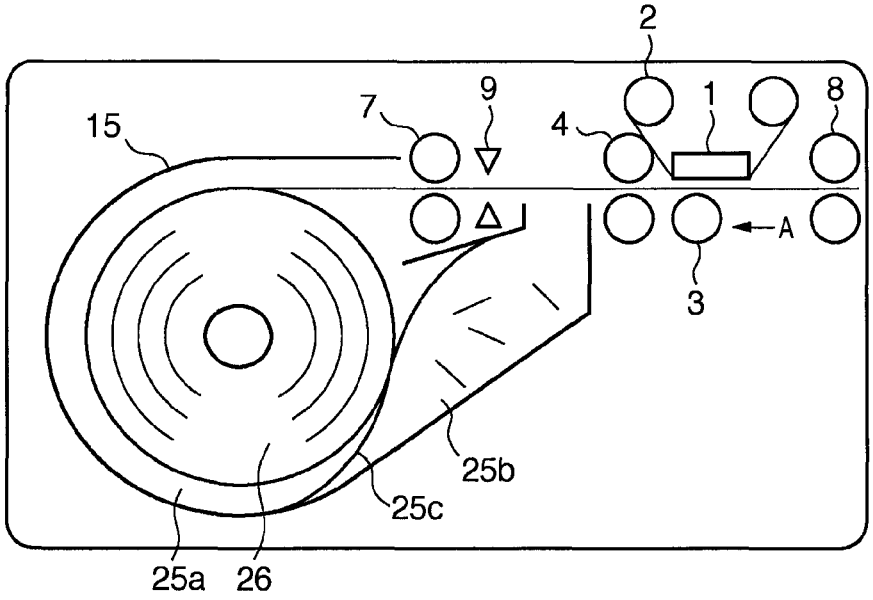
FIGS. 19A and 19B are cross-sections of a printing apparatus according to a seventh embodiment of the present invention.
Figure 19B:
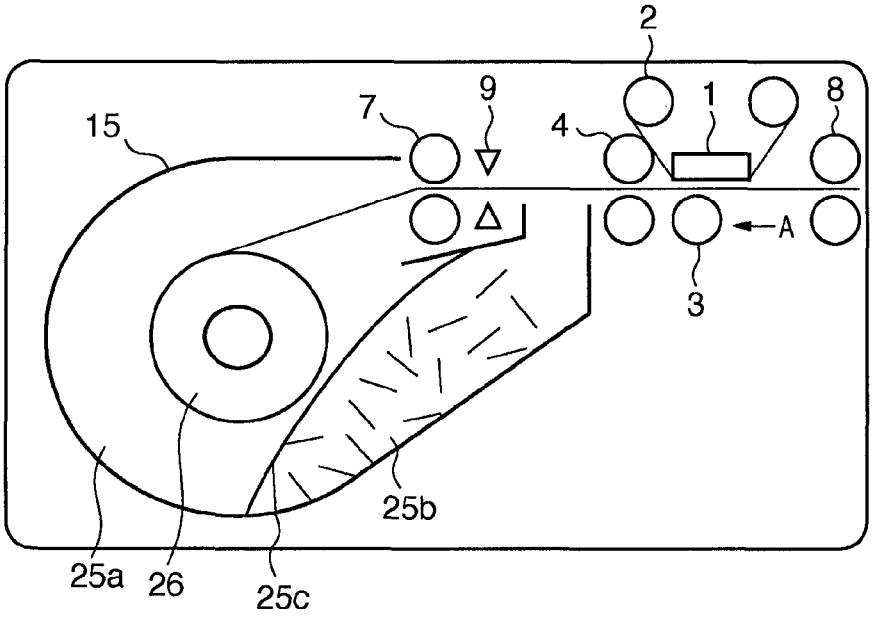

FIGS. 19A and 19B are cross-sections illustrating a printing apparatus according to a seventh embodiment of the present invention, provided with a cutter and a print sheet in roll form, conceptually illustrating the printing apparatus at an exaggerated scale for the sake of simplicity. The basic configuration is the same as that of the sixth embodiment, and thus only the differing portions shall be described. FIG. 19A illustrates a state immediately following the start of the use of the cartridge, whereas FIG. 19B illustrates a state immediately prior to the cartridge being completely used.

As in the sixth embodiment, the cartridge according to the seventh embodiment includes a print sheet containment portion 25*a* and a cut piece collection portion 25*b*, and a partition 25*c* is provided between the print sheet containment portion 25*a* and the cut piece collection portion 25*b*. The partition 25*c* is configured of an elastic member, and is furthermore biased toward the print sheet containment portion 25*a* (toward the consumables containment unit), making contact with a print sheet 26.

As shown in FIGS. 19A and 19B, the partition 25*c* is biased toward the print sheet containment portion 25*a*, and therefore, due to its own biasing force, moves toward the print sheet containment portion 25*a* as the print sheet 26 wound in roll form is consumed and the diameter thereof decreases. In other words, as the print sheet 26 is used, the space in the cut piece collection portion 25*b* gradually increases. Through this configuration, a similar effect as that of the sixth embodiment can be achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-003639, filed Jan. 10, 2008, which is hereby incorporated by reference herein in its entirety.

What is claimed is:

1. A cartridge that is detachable from a printing apparatus that includes a printing unit that prints onto a print medium and a cutter member that cuts the print medium, the cartridge comprising:

a print medium containment portion that contains print medium that are consumed along with printing operations performed by the printing unit;

a cut piece collection portion that collects cut pieces of the print medium resulting from cutting operations performed by the cutter member; and a partition member that separates the print medium containment portion from the cut piece collection portion, wherein the partition member is movable and formed of an elastic material, wherein the partition member is installed in the cartridge in a state in which the partition member is undergoing elastic deformation by being pushed by the print medium contained in the print medium containment portion, and the restoring force of the partition member resulting from the elastic deformation works in the direction that increases the capacity of the cut piece collection portion.

2. The cartridge according to claim 1, wherein the print medium is wound in roll form.

3. The cartridge according to claim 1, further comprising an ink sheet portion that contains an ink sheet in which a continuous sheet on which an ink layer is formed is wound in roll form.

4. The cartridge according to claim 1, wherein the partition member is biased toward the print medium containment portion.

5. The cartridge according to claim 1, wherein an aperture through which cut pieces of the print medium can pass is formed in the cut piece collection portion.

6. The cartridge according to claim 5, wherein the width of the longer side direction of the aperture is longer than the length of the longer side direction of the cut pieces, and the width of the shorter side direction of the aperture is shorter than the length of the shorter side direction of the cut pieces.

7. A printing apparatus to which the cartridge defined in claim 1 is detachable, the apparatus comprising:

a printing unit that prints onto a print medium; and a cutter member capable of cutting the print medium.

8. The printing apparatus according to claim 7, wherein the printing unit includes a thermal head in which a plurality of heaters is arranged linearly.

* * * * *